US006283163B1

(12) United States Patent
Kagi

(10) Patent No.: US 6,283,163 B1
(45) Date of Patent: Sep. 4, 2001

(54) ROD-SHAPED THREAD-GUIDING ELEMENT FOR TEXTILES MACHINES

(75) Inventor: Jorg Kagi, Gibswil (CH)

(73) Assignee: Bracker AG, Pfaffikon (CH)

( * ) Notice: Subject to any disclaimer, the term of this patent is extended or adjusted under 35 U.S.C. 154(b) by 0 days.

(21) Appl. No.: 09/508,726

(22) PCT Filed: Sep. 16, 1998

(86) PCT No.: PCT/CH98/00396

§ 371 Date: Jun. 5, 2000

§ 102(e) Date: Jun. 5, 2000

(87) PCT Pub. No.: WO99/14409

PCT Pub. Date: Mar. 25, 1999

(30) Foreign Application Priority Data

Sep. 16, 1998 (CH) ..... 2184/97

(51) Int. Cl.[7] ..... D03C 9/04
(52) U.S. Cl. ..... 139/93; 43/24
(58) Field of Search ..... 139/93, 94; 43/24

(56) References Cited

U.S. PATENT DOCUMENTS

| | | | | |
|---|---|---|---|---|
| 2,132,245 | | 10/1938 | Royle . | |
| 3,960,182 | | 6/1976 | Schwarz . | |
| 4,880,290 | * | 11/1989 | Kumazawa et al. | 350/96.2 |
| 5,052,446 | | 10/1991 | Gysin . | |
| 5,361,529 | * | 11/1994 | Lindler | 43/24 |

FOREIGN PATENT DOCUMENTS

| | | |
|---|---|---|
| 0 403 429 | 12/1990 | (EP) . |
| 608 426 | 7/1926 | (FR) . |
| 1 192 175 | 10/1959 | (FR) . |
| WO80/00719 | 4/1980 | (WO) . |

* cited by examiner

*Primary Examiner*—Andy Falik
(74) *Attorney, Agent, or Firm*—Adams, Schwartz & Evans, P.A.

(57) ABSTRACT

A rod-shaped thread guide element (1) for a textile machine disclosed. The guide element includes two metallic longitudinal sections (22, 24) which open out into a middle section (16). A threaded eye (10) is fixed in the middle section by an adhesive.

17 Claims, 1 Drawing Sheet

ROD-SHAPED THREAD-GUIDING ELEMENT FOR TEXTILES MACHINES

The invention relates to a rod-like thread guide element for textile machines, in particular a heddle, according to the preamble of claim 1. The invention relates, further, to a method for the production of a rod-like thread guide element according to the preamble of claim 8.

Rod-like thread guide elements designed as heddles for weaving machines are known. Heddles of this type have a thread eye, also referred to as a loop, and are used in weaving machines in order to raise and lower warp threads, which each run through the thread eye, for the purpose of forming the shed. Heddles of this type conventionally have a split middle portion which merges into a longitudinal portion on each of the two sides, the thread eye being soldered in the middle portion.

Heddles with a soldered-in thread eye have, inter alia, the disadvantage that they are relatively costly to produce and are relatively heavy.

The object of the present invention is to propose an economically more advantageous rod-like thread guide element for textile machines.

This object is achieved by means of a rod-like thread guide element having the features of claim 1.

Subclaims 2 to 7 relate to further advantageous embodiments of the thread guide element according to the invention.

The object is achieved, further, by means of a method for the production of a rod-like thread guide element for textile machines, in particular a heddle, having the features of claim 8. Subclaims 9 and 10 relate to further advantageous embodiments of the method according to the invention.

The object is achieved, in particular, by means of a rod-like thread guide element for textile machines which comprises two metallic longitudinal portions merging into a middle portion, a thread eye being fastened in the middle portion by means of an adhesive. The thread guide element is designed preferably as a round wire heddle or a flat steel heddle.

A heddle with a thread eye fastened by adhesive bonding has, for example, the following advantages, as compared with a heddle having a soldered-in thread eye:

The individual heddle has a lower overall weight.

A heddle frame of a weaving machine, comprising a multiplicity of individual heddles, likewise has a lower weight and therefore, for example, can be operated at a higher rotational speed or requires less energy to operate it.

There is no need to coat the thread eye by nickel-plating or tinning, this having been necessary hitherto for soldering in the thread eye. This allows more cost-effective production and, moreover, is ecologically more advantageous. In addition, the outermost surface of the thread eye, said surface being produced by nickel-plating or tinning, was relatively soft, so that there has hitherto been the risk that the guided warp threads would cut into this outermost surface.

The thread eye has preferably a hardened surface, the surface hardness having hitherto been reduced again by the heating occurring during soldering. Such a reduction in the surface hardness no longer occurs in the case of adhesive bonding.

The adhesive has higher resistance, as compared with chemical means, such as reviving, thus resulting in the heddle having a longer service life.

There is no risk that there will be solder residues which could cut into and thereby damage a warp thread.

No nickel peaks are formed, which have hitherto been produced during final electrolytic nickel-plating when soft solder residues have been present.

The curing time of an adhesive capable of being cured by means of ultraviolet radiation is shorter, as compared with a soft solder, thus, for example, making quicker manufacture possible.

Existing manufacturing machines for heddles can be converted in a simple way in that the operation of fastening the thread eye is carried out by adhesive bonding instead of by soldering.

Another advantage of the method according to the invention is to be seen in that a thread eye which cannot be soldered or which can be soldered only with difficulty may also be used. This also makes it possible, in future, to use substantially more wear-resistant thread eyes, for example made from solid ceramic or with ceramic coatings, for example PVD (Physical Vapor Deposition) or CVD (Chemical Vapor Deposition) layers.

The thread eye may consist of metal, for example of a rustproof steel, also referred to as "stainless steel", or of a high-alloy steel, and, moreover, may have a hardened surface, as can be achieved, for example, by case hardening, full hardening, tempering, nitriding or nitrocarbonization. The thread eye may also have an additionally applied hard layer which can be applied chemically, electrochemically or in a gas phase (PVD, CVD) . Such layers may, for example, be: chemical nickel and nickel dispersion layers or hard material layers based, for example, on (designation of the chemical elements) B, Ti, Cr, W, V, etc. or their compounds with nitrogen, carbon, oxygen, etc.

A large number of commercially available products are suitable as an adhesive. Advantageously, an adhesive is used which cures in a short time. An adhesive of this type is, for example, an adhesive which cures by being irradiated with ultraviolet light (UV light) and which cures, for example, within a time of between 0.1 and 20 seconds, for example in one second or in ten seconds. For example, a quick-curing adhesive of this type has a solidification time of 0.1 seconds and a full curing time of 10 to 20 seconds. Quick-acting adhesives which have a short curing time due to chemical or physical influences are suitable. An adhesive of this type may, for example, be produced on the base of polyester urethane acrylate.

A heddle is exposed to knocks during operation. The thread eye fastened to the heddle therefore preferably has, to some extent, elastic properties or some toughness. In order to ensure a permanent bond between the heddle and the thread eye, an advantageous adhesive likewise has some elastic properties or appropriate toughness. Moreover, the adhesive should have insensitivity to knocks.

In an advantageous embodiment, the thread eye, or at least the faces coming directly into contact with the warp threads, has a hardened surface with, for example, a nitrocarbonization depth of 20 to 50 micrometers.

After the thread eye has been fastened by means of adhesive, it may prove advantageous for the entire thread guide element, or at least the thread eye, the middle portion and the adhesive, to be covered with a metallic layer. This metallic layer is preferably applied by electroplating, for example by nickel-plating. One advantage of final nickel-plating of this type is to be seen in that the surface, in particular the surface of the rod-like thread guide element, which may also be formed from wires, has harder properties or properties which are more abrasion-resistant than the warp threads acting on it. The adhesive, which consists, in particular, of plastic, can be electroplated by means of methods known per se from other areas of technology.

The rod-like thread guide element according to the invention for textile machines is described in detail with reference to an exemplary embodiment of a round wire heddle. In the drawing.

Figure 1:
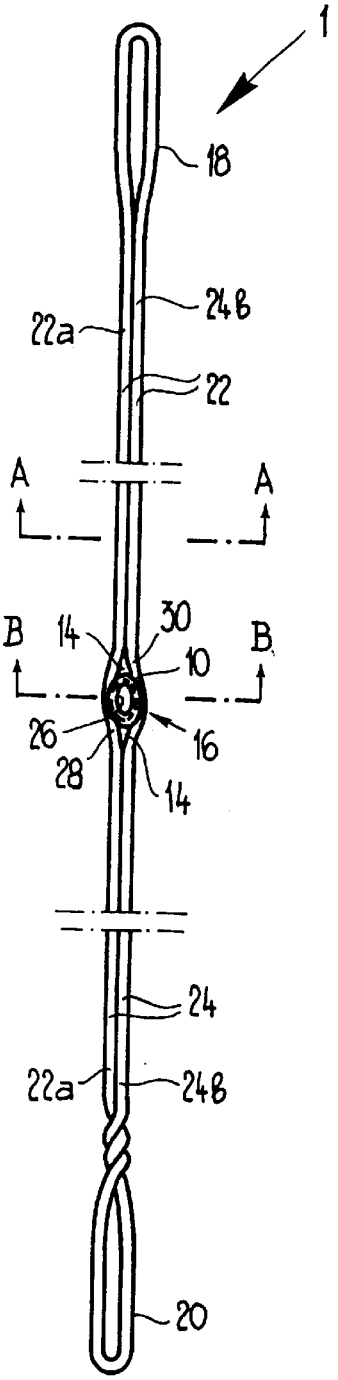
FIG. 1 shows a top view of a heddle.

The heddle 1 illustrated in FIG. 1 comprises two metallic longitudinal portions 22, 24 merging into a middle portion 16. The heddle 1 has two metallic round wires 22*a*, 24*b* which run parallel to one another and, in the middle portion 16, are at such a distance from one another that a thread eye 10 can be arranged between the round wires 22*a*, 24*b* in the middle portion 16. The thread eye 10 is fastened in the middle portion 16 by means of an adhesive 14. The longitudinal portions 22, 24 have, at each of their ends, an end loop 18, 20, illustrated merely by way of example. These ends may be designed in widely varying ways, for example even as hooks. The longitudinal portions 22, 24 are illustrated in shortened form. The middle portion 16 has two leg parts 28, 30 which are formed by the round wires 22*a*, 24*b* and between which the thread eye 10 is glued by means of adhesive 14. The thread eye 10 has an orifice 26, like a long hole, for guiding a thread.

The heddle 1 could also be designed as a flat steel heddle, with a perforation in the middle portion 16, in which case this perforation would be delimited by the leg parts 28, 30 and the thread eye 10 would be arranged between these leg parts 28, 30. In the case of a flat steel heddle of this type, the longitudinal portions 22, 24 and the middle portion 16 would be manufactured from one piece and from metal.

Figure 2:
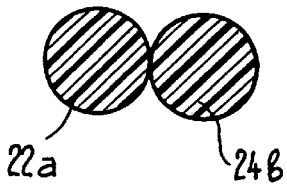
FIG. 2 shows a cross section along the line I—I according to FIG. 1.

FIG. 2 shows a cross section through the round wire heddle 1 according to FIG. 1 along the line I—I. This makes clear the cross section of the two round wires 22*a*, 24*b* mutually connected firmly to one another in the longitudinal portion 22, 24. The round wires 22*a*, 24*b* are, for example, connected firmly to one another by mutual tinning and nickel-plating. These round wires 22*a*, 24*b* could also have another cross-sectional shape, for example an oval shape.

Figure 3:
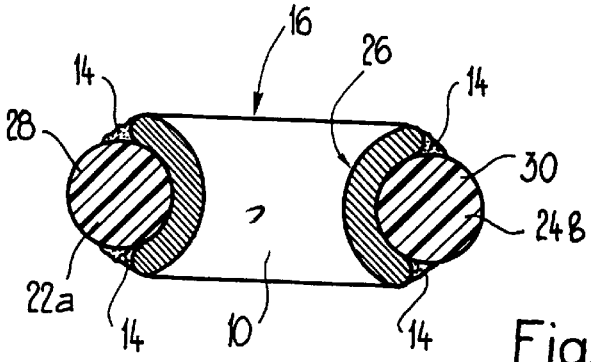
FIG. 3 shows a cross section along the line II—II according to FIG. 1.

FIG. 3 shows a cross section through the round wire heddle 1 according to FIG. 1 along the line II—II. This makes clear the two round wires 22*a*, 24*b* which in each case form a leg part 28, 30 and to which the thread eye 10 is firmly connected by means of the adhesive 14. The thread eye 10 has a kidney-shaped cross-sectional area, surrounds the round leg part 28, 30 over a portion and has a larger width than the leg parts 28, 30. The width of the thread eye 10, said width running in the vertical direction in relation to the illustration according to FIG. 3, could also be designed to be equal to or smaller than the width of the leg part 28, 30, and, for example, this would make it possible to have a higher heddle density and could have the effect of exercising greater care on a guided thread. The interspaces formed between the leg parts 28, 30 and the thread eye 10 are filled with adhesive 14, care being taken, in particular, to ensure that the surface of the adhesive 14 between the respective leg part 28, 30 and the thread eye 10 runs uniformly, so that the entire surface of the middle portion 16, together with the glued-in thread eye 10, has, if possible, no edges. This design of the surface makes it possible for a warp thread running through the thread eye 10 to be guided with great care. The thread eye 10 could also have other cross-sectional shapes and, for example, be of circular design. The adhesive 14 is preferably always applied in such a way that a continuously running surface, which has no edges, is obtained between the leg parts 28, 30 and the thread eye 10.

Figure 4:
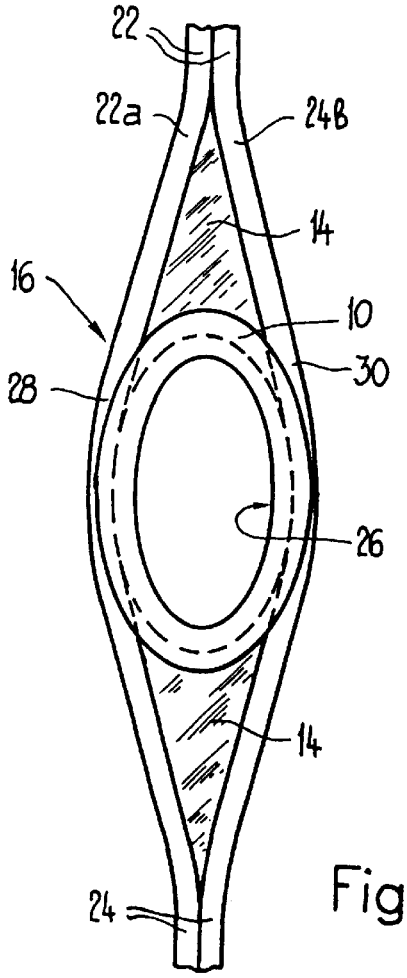
FIG. 4 shows a detailed view of the top view of the heddle with a thread eye arranged in it.

FIG. 4 shows a detailed view of the middle portion 16 of the heddle 1, the middle portion 16 comprising the two leg parts 28, 30 which are parts of the round wires 22*a*, 24*b*. The thread eye 10 is inserted between the leg parts 28, 30, the leg parts 28, 30 and the thread eye 10 being partially in direct contact with one another, and the remaining interspace, located between the two leg parts 28, 30 and the thread eye 10, being filled with adhesive 14, so that the thread eye 10 is held firmly in the middle portion 16 and, with the exception of the orifice 26, there are no cavities in the middle portion 16. A relatively large interspace above and below the thread eye 10 is filled with adhesive 14. By virtue of elastic and tough properties of the adhesive 14, the adhesive 14 located in this interspace acts as a damping element, so that the thread eye 10 is held between the leg parts 28, 30 so as to be insensitive to knocks. This results, even in the case of very high stroke frequencies of the heddle 1, in a permanent bond between the thread eye 10 and the round wires 22*a*, 24*b*.

The heddle according to the invention is produced, for example, by feeding the individual thread eyes 10 to a vibrating machine and subsequently storing them on a mandrel. The thread eye 10 is thereupon inserted into the middle portion 16 and, by means of a dipping or dabbing method, the adhesive is introduced into the interspace between the thread eye 10 and the two legs 28, 30. The adhesive, which cures quickly under UV light, remains between the round wires 22*a* and 24*b* and the thread eye 10 due to the capillary effect. By being irradiated with UV light, the adhesive is cured within a time of between 0.1 and 20 seconds. During irradiation with UV light, the heddle may, for example, be conveyed on a transport rail. The quick-curing adhesive solidifies after 0.1 seconds, the heddle 1 being irradiated with ultraviolet light for a further 10 seconds, until the ultraviolet-curable (UV-curable) adhesive is cured. Depending on the selected adhesive and the UV radiation intensity, the irradiation period may also last for less than 10 seconds, for example 1 second, or else for longer than 10 seconds.

For example, a two-component epoxy adhesive is suitable as the adhesive. Furthermore, for example, an adhesive from the group of acrylic adhesives and modified versions, such as UV-curable adhesives, are suitable.

What is claimed is:

1. A rod-like thread guide element (1) for textile machines, comprising two metallic longitudinal portions (22, 24) which merge into a middle portion (16) withing which a threaded eye (10) is bonded to the metallic longitudinal portions (22, 24) by means of an adhesive (14), wherein the adhesive (14) is selected from the group consisting of acrylic adhesives and a two-component epoxy adhesive, and wherein the adhesive can be cured chemically or physically within from 0.1 to 20 seconds.

2. A rod-like thread guide element as claimed in claim 1, wherein the thread guide element (1) is a round wired heddle comprising at least two round wires (22*a*, 24*b*), and wherein the thread eye (10) is arranged between the round wires (22*a*, 24*b*) running at a distance from one another in the middle portion (16).

3. A rod-like thread guide element as claimed in claim 1, wherein the thread guide element (1) is a flat steel heddle with a perforation in the middle portion (16), and wherein the thread eye (10) is arranged in this perforation.

4. A rod-like thread guide element as claimed in claim 1, wherein the thread eye (10) has a wear-resistant surface.

5. A rod-like thread guide element (1) as claimed in claim 1, wherein the adhesive is UV-curable.

6. A rod-like thread guide element (1) as claimed in claim 1, wherein at least the middle portion (16) together with the thread eye (10) and adhesive (14) are covered with a metallic layer.

7. A rod-like thread guide element (1) as claimed in claim 6, wherein the longitudinal portions (22, 24) are covered with a metallic layer.

8. A rod-like thread guide element (1) as claimed in claim 6, wherein the layer is applied by electroplating.

9. A rod-like thread guide element as claimed in claim 1, wherein the thread eye (10) is formed of a material selected from the group consisting of plastic, ceramic and metal.

10. A rod-like thread guide element as claimed in claim 1, wherein the wear-resistant surface comprises a hardened material.

11. A rod-like thread guide element as claimed in claim 1, wherein the wear-resistant surface comprises a nitrided hard material.

12. A rod-like thread guide element as claimed in claim 1, wherein the wear-resistant surface comprises a coated hard material.

13. A rod-like thread guide element as claimed in claim 1, wherein the wear-resistant surface comprises a solid ceramic.

14. A method for the production of a rod-like thread guide element (1) for textile machines comprising the steps of:

(a) providing two metallic longitudinal portions (22, 24) which merge into a middle portion;

(b) positioning a thread eye (10) in the region of the middle portion;

(c) binding the thread eye to the longitudinal portions (22, 24) in the region of the middle portion by:

(i) supplying an adhesive (14) selected from the group consisting of acrylic adhesives and a two-component epoxy adhesive (14) and chemically or physically curing the adhesive within a time of less than 20 seconds in such a way that the thread eye (10) is bonded firmly to the middle portion (16) by means of the cured adhesive (14).

15. The method as claimed in claim 13, further comprising curing the adhesive (14) by ultraviolet radiation.

16. A heddle frame comprising rod-like threaded guide elements, each of said guide elements comprising two metallic longitudinal portions (22, 24) which merge into a middle portion (16) within which a thread eye (10) is bonded to the metallic longitudinal portions (22, 24) by means of an adhesive (14), wherein the adhesive (14) is selected from the group consisting of acrylic adhesives and a two-component epoxy adhesive, and wherein the adhesive can be cured chemically or physically within from 0.1 to 20 seconds.

17. A weaving machine comprising rod-like threaded guide elements, each of said guide elements comprising two metallic longitudinal portions (22, 24) which merge into a middle portion (16) within which a thread eye (10) is bonded to the metallic longitudinal portions (22, 24) by means of an adhesive (14), wherein the adhesive (14) is selected from the group consisting of acrylic adhesives and a two-component epoxy adhesive, and wherein the adhesive can be cured chemically or physically within from 0.1 to 20 seconds.

* * * * *